US006170407B1

(12) United States Patent
Hayward

(10) Patent No.: US 6,170,407 B1
(45) Date of Patent: Jan. 9, 2001

(54) FOLDING LEG MECHANISM

(75) Inventor: James Hayward, Torrance, CA (US)

(73) Assignee: Spec Furniture Inc., Concord (CA)

( * ) Notice: Under 35 U.S.C. 154(b), the term of this patent shall be extended for 0 days.

(21) Appl. No.: 09/361,224

(22) Filed: Jul. 27, 1999

(51) Int. Cl.[7] ..... A47B 35/00
(52) U.S. Cl. ..... 108/50.02; 108/132
(58) Field of Search ..... 108/90.01, 131, 108/132, 115; 244/188.6, 188.1, 434, 167

(56) References Cited

U.S. PATENT DOCUMENTS

| | | | | |
|---|---|---|---|---|
| 3,695,567 | * | 10/1972 | Weagle | 108/132 X |
| 4,238,100 | * | 12/1980 | Shy | 108/132 X |
| 5,205,223 | * | 4/1993 | Ball et al. | 108/115 X |
| 5,337,657 | * | 8/1994 | Diffrient | 108/50.02 X |
| 5,640,912 | * | 6/1997 | Diffrient | 108/50.02 |
| 5,673,632 | * | 10/1997 | Sykes | 108/50.02 X |
| 5,927,214 | * | 7/1999 | Schwartz et al. | 108/50.02 |
| 5,934,201 | * | 8/1999 | Diffrient | 108/50.02 |
| 5,992,333 | * | 11/1999 | Lai | 108/115 X |
| 6,003,447 | * | 12/1999 | Cox et al. | 108/50.02 |

* cited by examiner

*Primary Examiner*—Jose V. Chen
(74) *Attorney, Agent, or Firm*—Bereskin&Parr

(57) ABSTRACT

A folding table leg mechanism for mounting to a tabletop, having a leg support with an extension portion and a base portion fixedly mounted to the extension portion, and a mounting mechanism for pivotally connecting the leg support to the tabletop. The mounting mechanism has a hinge joint for pivoting the leg support in a pivot plane substantially perpendicular to the tabletop plane from a collapsed position in which the leg support is substantially parallel to the tabletop to an erect position in which the leg support is substantially perpendicular to the tabletop, and also has a rotation joint for rotating the leg support about a rotation axis substantially perpendicular to the tabletop when the leg support is in the erect position, from a first rotational position to a second rotational position. The leg support may be locked in place when it is in the second rotational position. The mechanism may also include a cord tray pivotally coupled to the leg support wherein the cord tray pivots with the leg support when the leg support is pivoted between the collapsed position and the erect position, but wherein the cord tray remains fixed in position relative to the tabletop when the leg support is rotated between the first rotational position and the second rotational position.

11 Claims, 4 Drawing Sheets

FOLDING LEG MECHANISM

FIELD OF THE INVENTION

This invention relates to the field of folding support legs.

BACKGROUND OF THE INVENTION

Some prior art folding table legs comprise an articulated cross-support mechanism which spans between the leg and the underside of the tabletop. Often, the cross-support mechanism has a hinge in its middle which permits it to fold back upon itself when the leg is collapsed against the tabletop, but which is designed to prevent the cross-support from pivoting much past 180° at its full extension, when the leg is erected. These cross-supports maintain their spanning strength through the use of gravity or some form of friction lock which works to keep the cross-support extended. Such support legs tend to be flimsy and easily collapsed by accident once erected.

Additionally, many collapsible table leg designs fail to provide means for maintaining the table leg in its collapsed position. In order to keep the legs from extending and becoming obstructive, it is typically necessary to ensure that the table is transported and stored in an upside-down position.

Furthermore, many collapsible tables fail to provide means for organizing power cords and cables from computers and other electronic devices. As a result, these cords and cables typically fall haphazardly down the back of the table and are at risk of being tangled up with someone's feet when they are stretching their legs underneath the table.

Accordingly, it has been recognized that there is a need for a collapsible table support mechanism, which is sturdy, simple to use, and which is capable of locking the support in both its collapsed and extended positions. It has also been recognized that there is a need for a collapsible table support mechanism which provides a mechanism for keeping power cords and cables from devices in use on the table together, thereby reducing the risk that such cables might be tangled up with a user's feet when seated at the table.

SUMMARY OF THE INVENTION

The present invention is directed towards folding support legs.

The folding table leg mechanism of the subject invention is for use with a tabletop having a tabletop plane, and includes a leg support having an extension portion and a base portion fixedly mounted to the extension portion, and a mounting mechanism for pivotally connecting the leg support to the tabletop. The mounting mechanism has a hinge joint for pivoting the leg support in a pivot plane substantially perpendicular to the tabletop plane, from a collapsed position in which the leg support is substantially parallel to the tabletop plane to an erect position in which the leg support is substantially perpendicular to the tabletop. The mounting mechanism also has a rotation joint for rotating the leg support about a rotation axis substantially perpendicular to the tabletop plane when the leg support is in the erect position, from a first rotational position to a second rotational position. The mechanism may also include a cord tray pivotally coupled to the leg support wherein the cord tray pivots with the leg support when the leg support is pivoted between the collapsed position and the erect position, but wherein the cord tray remains fixed in position relative to the tabletop when the leg support is rotated between the first rotational position and the second rotational position.

BRIEF DESCRIPTION OF THE DRAWINGS

The present invention will now be described, by way of example only, with reference to the following drawings, in which like reference numerals refer to like parts and in which.

DETAILED DESCRIPTION OF THE PREFERRED EMBODIMENT

Figure 1:
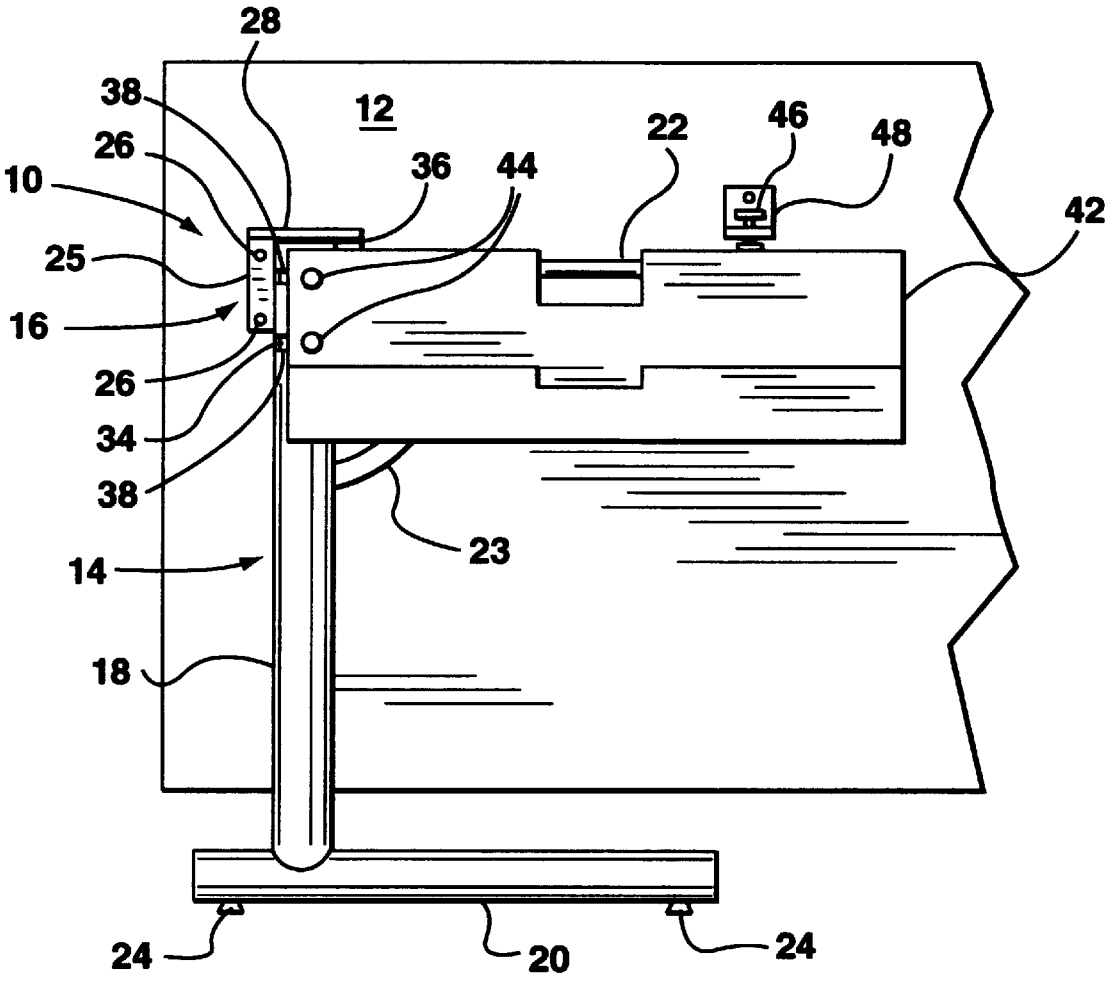
FIG. 1 is a bottom plan view of a folding table leg mechanism manufactured in accordance with the subject invention, in which the leg support is locked in a collapsed position.
Figure 2:
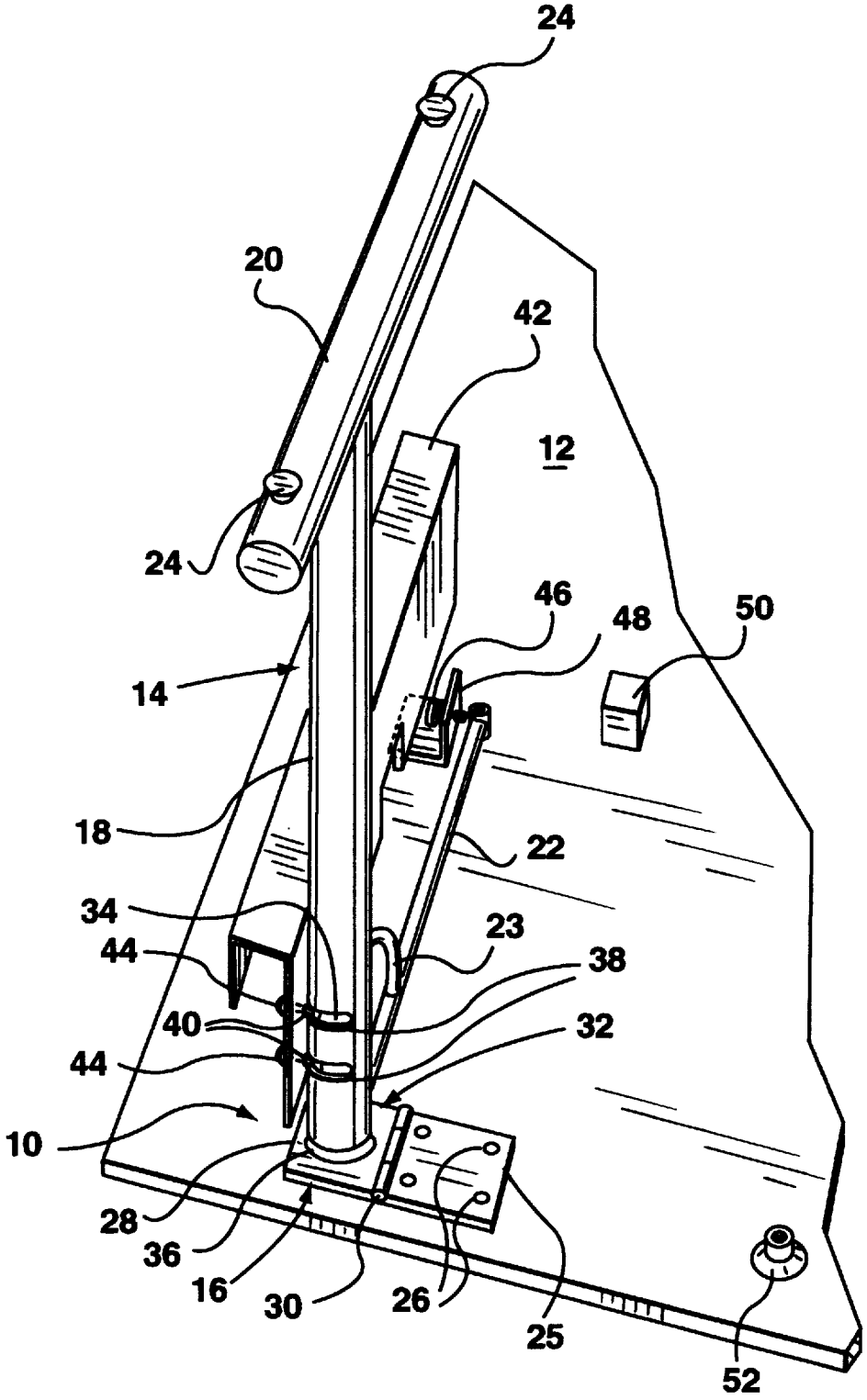
FIG. 2 is a side perspective view of the folding table leg mechanism of FIG. 1, in which the mechanism has been raised to an erect position, and in which the mechanism is in the first rotational position.

Referring simultaneously to FIGS. 1 and 2, illustrated therein is a folding table leg mechanism, shown generally as 10 made in accordance with a preferred embodiment of the subject invention. Leg mechanism 10 is mounted to the underside of a tabletop 12 and comprises a leg support 14 and a mounting mechanism 16 for pivotally connecting the leg support 14 to the tabletop 12. In FIG. 1, the leg support 14 is shown locked in its collapsed position.

The leg support 14 comprises an elongate extension portion 18, and a base portion 20 which is mounted to the bottom of the extension portion 18, and which extends in a substantially perpendicular direction relative to the extension portion 18. The leg support 14 also preferably comprises a support arm 22 which is mounted to the upper end of the extension portion 18, proximate the tabletop 12. Preferably a brace 23 extends between and is mounted to both the extension portion 18 and the support arm 22. Base portion 20 may also comprise adjustable feet 24, which have screw threads so that they may be screwably height adjusted with respect to the base member 20, for optimal contact with the floor, as will be understood by one skilled in the art. Preferably, the extension portion 18, the base portion 20, the support arm 22, and the brace 23 are of cylindrical tubular metal construction which have been welded together.

The mounting mechanism 16 comprises a first support plate 25 which is mounted to the underside of the tabletop 14, typically through the use of mounting screws 26, and a second support plate 28 which is pivotally coupled to the first support plate 25 by a hinge joint 30. The mounting mechanism 16 also comprises a rotation joint 32, which includes an insert cylinder 34 welded to the second support plate 28, which is shaped to slidably fit inside the extension portion 18 of the leg support 14. The rotation joint 32 also includes a gasket 36 which is positioned between the top of the extension portion 18 and the second support plate 28, to reduce friction.

Two slots 38 have been cut through the extension portion 18, exposing the insert cylinder 34, beneath. Two mounting portions 40, one corresponding to each slot 38, have been welded to the insert cylinder 34, and extend through the slots 38. Each mounting portion 40 has been threaded to receive a bolt.

Figure 4:
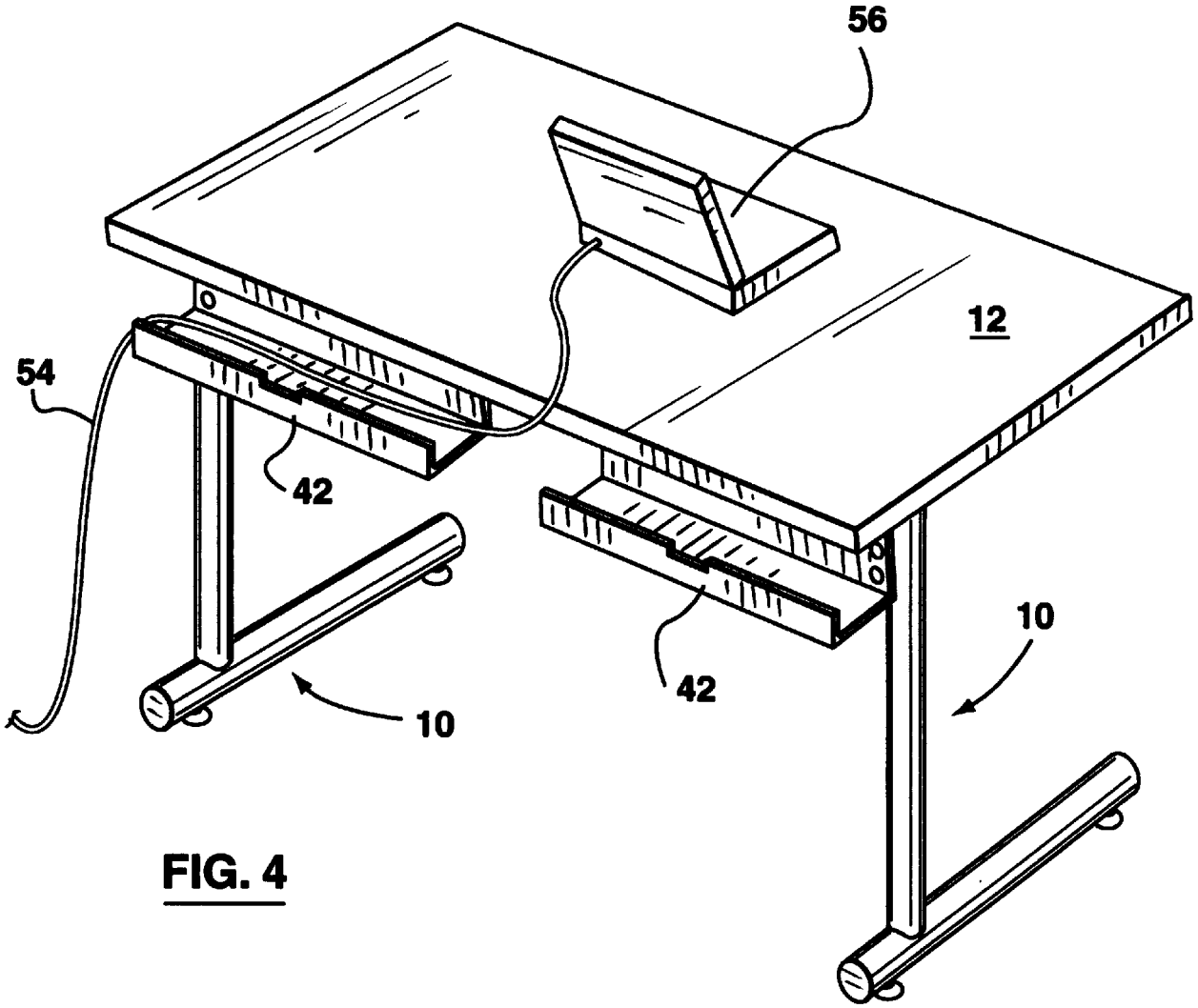
FIG. 4 is a top rear perspective view of a table comprising two folding table leg mechanisms of the subject invention, in which the leg mechanisms have been erected and locked in place.

A cord tray 42 is preferably mounted to the mounting portions 40, by bolts 44, although it should be understood that the leg support 14 will function to support the tabletop 12 if a cord tray 42 is not included. The cord tray 42 is typically substantially in the shape of a squared-off "J" in cross-section, and forms a trough to receive electrical cords and cables 54 from computer 56 and other electronic equipment which may be sitting on upper side of the tabletop 12, and directs them to the edge of the tabletop 12, before they drop to the floor, as illustrated in FIG. 4 in which two separate folding table leg mechanisms 10 have been mounted to the underside of a tabletop 12.

The support arm 22 preferably comprises a locking bolt 46, which has been threaded through the distal end of the arm 22. A first engaging mount 48 has been mounted to the underside of the tabletop 12, which is threaded to receive the locking bolt 46. When the locking bolt 46 has been threaded into the first engaging mount 48, the leg support 14 is locked in the collapsed position, relative to the tabletop 12. The mechanism 10 may also comprise a support pad 50, which provides support to the distal end of the cord tray 42, when the leg support 14 is in the collapsed position.

Figure 3:
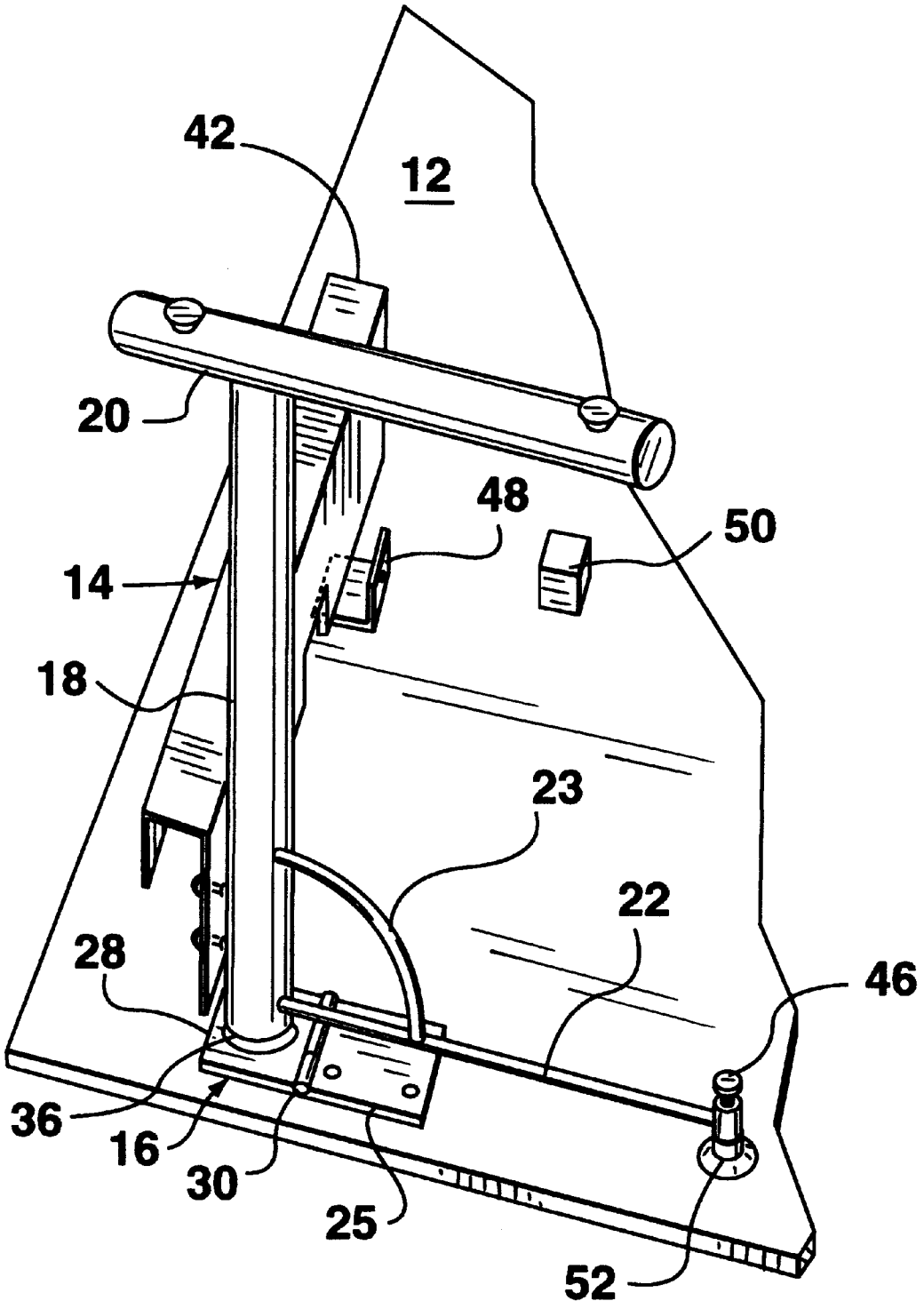
FIG. 3 is a side perspective view of the folding table leg mechanism of FIG. 1, in which the mechanism has been raised to an erect position, rotated to the second rotational position and locked in place.

A second engaging mount 52 has been mounted to the underside of the tabletop 12, which is threaded to receive the locking bolt 46. When the locking bolt 46 has been threaded into the second engaging mount 52, as illustrated in FIG. 3, the leg support 14 is locked in the erect, second rotational position, relative to the tabletop 12.

When storing or transporting the tabletop 12, the leg support 14 may be locked in the collapsed position as shown in FIG. 1, with the locking bolt 46 threaded through the first engaging mount 48 and the support arm 22. As should be understood, in the collapsed position, the leg support 14 is substantially parallel to the plane formed by the underside of the tabletop 12. When a user wishes to utilize the tabletop 12, the locking bolt 46 is unscrewed from the support arm 22, and the leg support 14 is raised to an erect position in the first rotational position, as illustrated in FIG. 2, by pivoting the leg support 14 approximately 90° through a pivot plane which is substantially perpendicular to the tabletop plane. In this position, the extension portion 18 of the leg support 14 is substantially perpendicular to the tabletop plane. The leg support 14 is then rotated approximately 90° about a rotation axis which aligns substantially with the extension portion 18 of the leg support, thereby aligning the free end of the support arm 22 with the second engaging mount 52. The locking bolt 46 is then threaded through the support arm 22 and the second engaging mount 52, as illustrated in FIG. 3.

While what is shown and described herein constitute the preferred embodiments of the subject invention, it should be understood that various changes can be made without departing from the subject invention, the scope of which is defined in the appended claims.

I claim:

1. A folding table leg mechanism for mounting to a tabletop having a tabletop plane, comprising:

(a) a leg support comprising an extension portion and a base portion fixedly mounted to the extension portion;

(b) a mounting mechanism for pivotally connecting the leg support to the tabletop, comprising:

(i) a hinge joint for pivoting the leg support in a pivot plane substantially perpendicular to the tabletop plane from a collapsed position in which the leg support is substantially parallel to the tabletop plane to an erect position in which the leg support is substantially perpendicular to the tabletop, and (ii) a rotation joint for rotating the leg support about a rotation axis substantially perpendicular to the tabletop plane when the leg support is in the erect position, from a first rotational position to a second rotational position; and (c) a cord tray pivotally coupled to the leg support wherein the cord tray pivots with the leg support when the leg support is pivoted between the collapsed position and the erect position, but wherein the cord tray remains fixed in position relative to the tabletop when the leg support is rotated between the first rotational position and the second rotational position.

2. The mechanism as defined in claim 1, wherein the base portion of the leg support extends in a substantially perpendicular direction relative to the extension portion.

3. A folding table leg mechanism for mounting to a tabletop having a tabletop plane, comprising:

a leg support comprising an extension portion and a base portion fixedly mounted to the extension portion;

a mounting mechanism for pivotally connecting the leg support to the tabletop, comprising:

(i) a hinge joint for pivoting the leg support in a pivot plane substantially perpendicular to the tabletop plane from a collapsed position in which the leg support is substantially parallel to the tabletop plane to an erect position in which the leg support is substantially perpendicular to the tabletop, and (ii) a rotation joint for rotating the leg support about a rotation axis substantially perpendicular to the tabletop plane when the leg support is in the erect position, from a first rotational position to a second rotational position; and wherein the leg support comprises an arm support fixedly mounted to and extending in a substantially perpendicular direction from the extension portion proximate the tabletop.

4. A folding table leg mechanism for mounting to a tabletop having a tabletop plane, comprising:

(a) a leg support comprising an extension portion and a base portion fixedly mounted to the extension portion;

(b) a mounting mechanism for pivotally connecting the leg support to the tabletop, comprising:

(i) a hinge joint for pivoting the leg support in a pivot plane substantially perpendicular to the tabletop plane from a collapsed position in which the leg support is substantially parallel to the tabletop plane to an erect position in which the leg support is substantially perpendicular to the tabletop, and (ii) a rotation joint for rotating the leg support about a rotation axis substantially perpendicular to the tabletop plane when the leg support is in the erect position, from a first rotational position to a second rotational position; and wherein the extension portion of the leg support is substantially cylindrical, and wherein the rotation joint comprises an insert segment which is substantially cylindrical and which is sized to slidably fit within the extension portion.

5. The mechanism as defined in claim 4, wherein the extension portion of the leg support comprises at least one slot through the side of the extension portion and extending partway around the circumference of the extension portion.

6. The mechanism as defined in claim 5, wherein the insert segment comprises at least one mounting portion fixedly mounted to the insert segment and extending through the slot.

7. The mechanism as defined in claim 6, wherein a cord tray is mounted to the mounting portion.

8. The mechanism as defined in claim 7, wherein the mounting portion has been threaded to receive a bolt, and wherein the cord tray is bolted to the mounting portion.

9. The mechanism as defined in claim 3, wherein the arm support comprises a threaded locking bolt screwably mounted through the arm support.

10. The mechanism as defined in claim 9, wherein the tabletop comprises a first engaging mount which has been threaded to receive the locking bolt, fixedly mounted to the underside of the tabletop, wherein the first engaging mount is positioned to receive the locking bolt when the leg support is in the collapsed position, thereby locking the leg support in position relative to the tabletop.

11. The mechanism as defined in claim 10, wherein the tabletop comprises a second engaging mount which has been threaded to receive the locking bolt, fixedly mounted to the underside of the tabletop, wherein the first engaging mount is positioned to receive the locking bolt when the leg support is in the second rotational position, thereby locking the leg support in position relative to the tabletop.

* * * * *